United States Patent [19]

Baker

[11] 4,369,023

[45] Jan. 18, 1983

[54] SHOT MAKING APPARATUS

[76] Inventor: David S. Baker, 12 K Davies La., New Plymouth, New Zealand

[21] Appl. No.: 174,751

[22] Filed: Aug. 4, 1980

[30] Foreign Application Priority Data

Aug. 6, 1979 [NZ] New Zealand ..... 191215

[51] Int. Cl.[3] ..... B22F 9/08

[52] U.S. Cl. ..... 425/10; 164/81

[58] Field of Search ..... 264/5, 6, 9–14; 425/6–8, 10; 164/81

[56] References Cited

U.S. PATENT DOCUMENTS 3,150,212 9/1964 Jacklin ..... 264/13

4,108,927 8/1978 Francis et al. ..... 264/13

FOREIGN PATENT DOCUMENTS 741088 9/1943 Fed. Rep. of Germany ..... 425/6

*Primary Examiner*—Gus T. Hampilos

*Assistant Examiner*—K. Y. Lin

*Attorney, Agent, or Firm*—Blakely, Sokoloff, Taylor & Zafman

[57] ABSTRACT

The present invention is a shot making apparatus which allows rapid and reliable production of shot and which is relatively compact in size. The shot making apparatus comprises a receptacle for lead, at least one nozzle for discharging molten lead in droplet form from the receptacle, a heating means being disposed such as to heat the chute, a chute being disposed at a spacing from and at a downwardly inclined angle to the nozzle(s), and a container(s) for liquid coolant and lead droplets discharged from said nozzle(s).

19 Claims, 7 Drawing Figures

SHOT MAKING APPARATUS

BACKGROUND OF THE INVENTION

This invention relates to shot making apparatus.

A number of different methods of producing lead shot are known. The most widely used commercial method involves dropping droplets on molten lead from towers so that droplets are cooled and hardened during their fall, the flow of air or other fluid around the droplets during their fall imparting a spherical shape to the droplets. Other methods for the production of shot, especially in smaller quantities, involve mounting lead sticks in a bath, discharging the lead in droplet form from the bath, and conducting the lead droplets down into a reservoir of water. Although this method and the associated apparatus enable low volume production of shot without requiring the heights usually associated with commercial shot production, there are difficulties in controlling the pressure of the lead discharge from the bath with the result that the lead may be discharged in the form of a continuous stream rather than individual droplets. In addition, the path of the lead droplets after being discharged from the bath must be set within certain limits or else the resulting shot may be square or "doughnut"-shaped instead of spherical. Moreover, the parameters determining the optimum path for the lead droplets vary according to the size of shot to be produced, and there should be provision for adjustment of the apparatus if it is desired to produce different size shot.

BRIEF DESCRIPTION OF THE INVENTION

The present invention therefore has as its object the provision of shot making apparatus which may allow rapid and reliable production of shot and which is relatively compact in size.

Other objects and advantages of the invention will be apparent from the following description.

According to its broadest form the present invention provides shot making apparatus comprising a receptacle for lead, heating means, at least one nozzle for discharging molten lead in droplet form from the receptacle, a chute associated with the nozzle(s), the heating means being disposed such as to heat the chute, the nozzle(s) and the lead in the receptacle, the chute being disposed at a spacing from and at a downwardly inclined angle to the nozzle(s), and a container or containers for liquid coolant and lead droplets discharged from said nozzle(s).

In one form of the invention the shot making apparatus comprises a tray with a sloping floor with the nozzle or nozzles situated in the end side of the tray toward which the floor slopes. The nozzle is preferably removable from the said end wall so that different size nozzles can be interchanged. The heating means can be a gas burner or electric element which is situtated beneath the floor of the tray but so positioned that not only is the floor of the tray heating but also the chute and nozzle(s).

DESCRIPTION OF PREFERRED FORMS OF THE INVENTION

Figure 1:
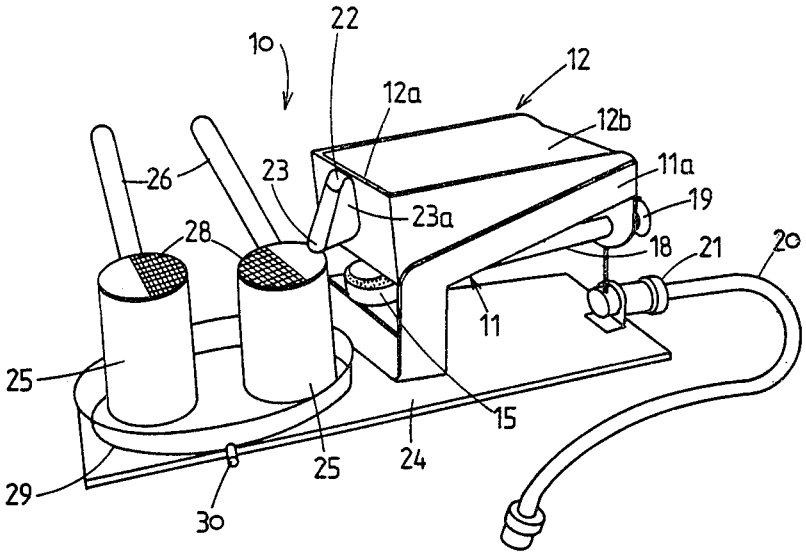
FIG. 1 is a perspective view of a first form of the shot making apparatus according to the invention.
Figure 2:
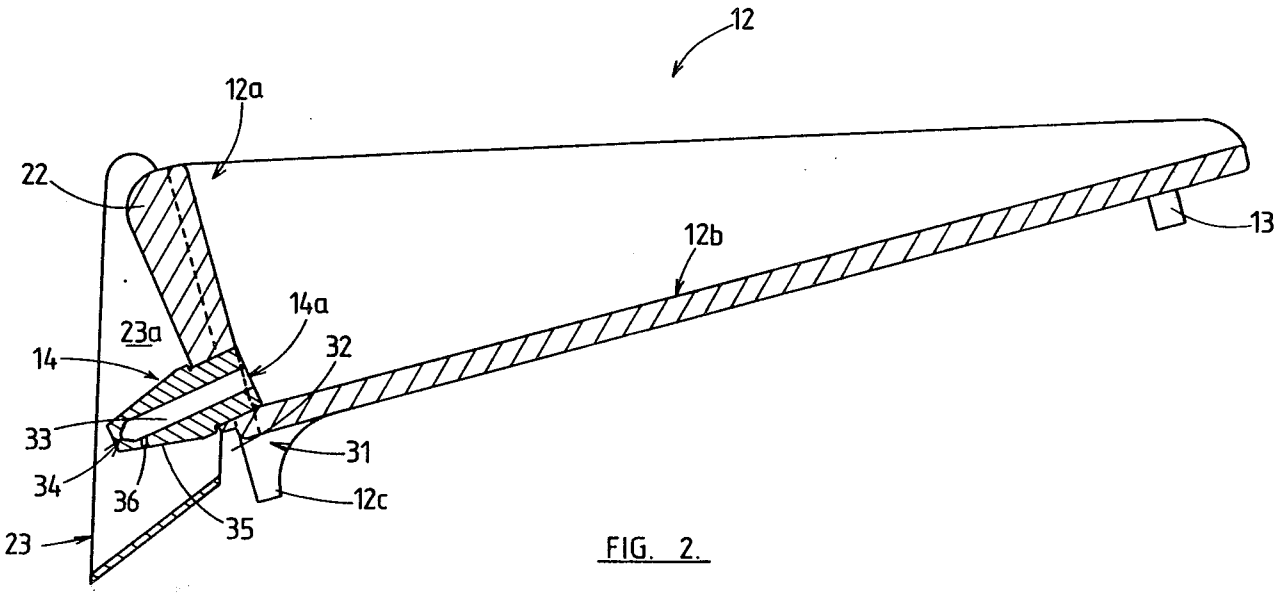
FIG. 2 is a longitudinal cross section taken through the tray of the apparatus depicted in FIG. 1.
Figure 3:
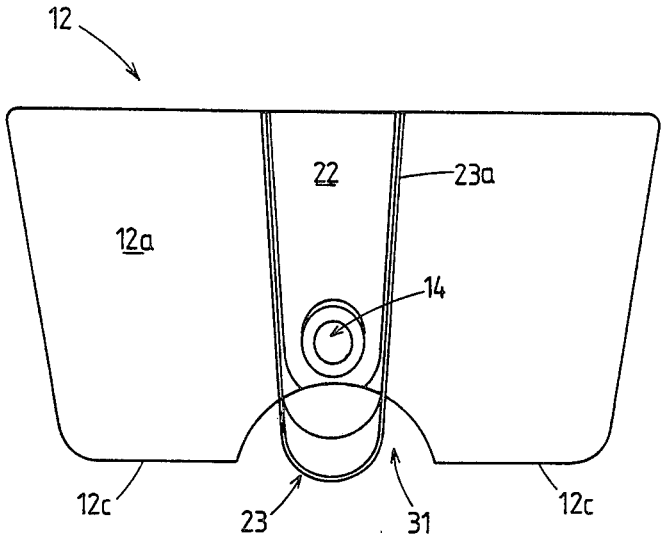
FIG. 3 is a front end view of the tray of the apparatus depicted in FIGS. 1 and 2.
Figure 6:
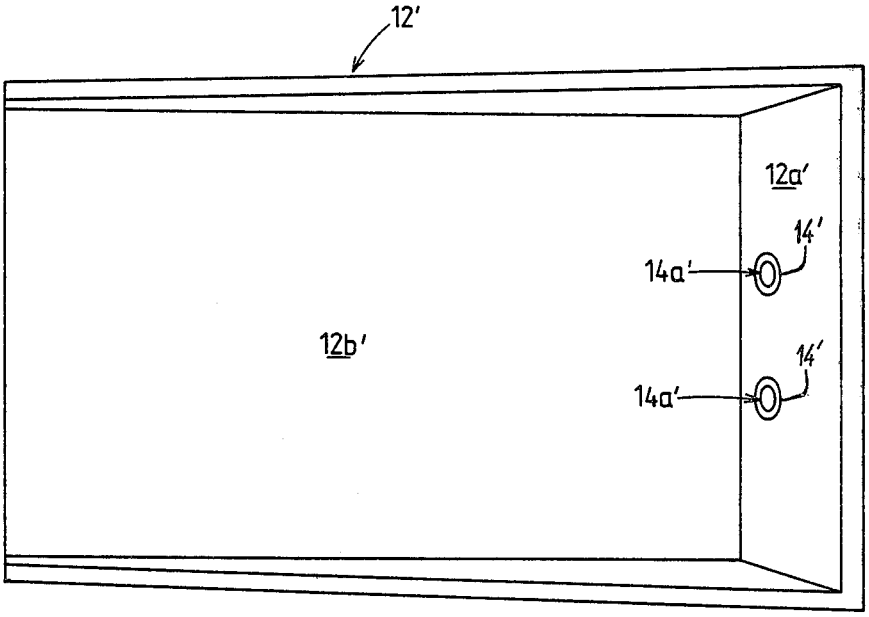
FIG. 6 is a plan view of the tray of the apparatus shown in FIG. 4.

Referring firstly to FIGS. 1, 2 and 3 the apparatus 10 comprises a support stand 11, in the upper part of 11*a* of which is mounted a tray for melting lead, the lead being supplied to the tray in solid form. The tray 12 is removably mounted on the stand 11 and is located in place by suitable means such as, for example, locating lugs 13 engaging with supports such as cross members (not shown) in the upper part 11*a*. In the preferred form the tray 12 is of cast metal construction.

On its front side 12*a*, adjacent the floor 12*b*, the tray 12 is provided with a removable outlet nozzle 14 for the discharge of molten lead in droplet form. Whilst only one outlet nozzle 14 is illustrated two or more such nozzles can be provided as will hereinafter be described.

Mounted beneath the tray 12 is a heating unit consisting of a gas burner 15 with a supply pipe 18 and regulator valve control 19. A gas supply hose 20 is coupled to a safety valve coupling arrangement 21. Hose 20 is, in use, connected to a gas supply such as a gas bottle (not shown).

The front side 12*a* of tray 12 has a carrier section 22 in which nozzle 14 is located. This carrier section 22 also mounts a chute 23 which is located beneath nozzle 14 and extends downwardly away at an incline to the nozzle. Conveniently the chute 23 is of substantially U shape with side flanges 23*a* thereof being attached to carrier section 22.

For preference support stand 11 is mounted on a base 24 which besides providing a location for stand 11 also forms a platform for receptacles into which fall the droplets of molten lead issuing from nozzle 14. The receptacles are in the illustrated form a pair of containers 25 each of which has a handle 26. The open top 27 of each container 25 is preferably partially covered by a mesh screen 28. These containers rest on the floor of an over flow tray 29 which is located on base 24. Over flow tray 29 is provided with a drain outlet 30 whereby fluid over flowing from the containers 25 can pass into a suitable receptacle or bulk storage container (not shown).

In use each container 25 is filled with a liquid coolant, in particular oil, with the open top of one container being positioned beneath chute 23 to receive lead droplets issuing from the chute. The oil fills the container 25 to the brim thus oil which over flows as a result of the lead droplets passing into the container flows into the over flow tray 29.

In use of the apparatus 10, pieces of scrap lead or other pieces of lead in solid form are placed in the tray 12, the regulator valve 19 is turned on and gas exhausting from the burner outlets of burner 15 is ignited. The resultant gas flame heats the underside of the tray 12, the chute 23 and the nozzle 14. This heating of the chute 23 and nozzle 14 is achieved due to the construction of the tray 12 and chute 23 as can be more readily seen from FIGS. 2 and 3.

Referring to these particular Figures it will be seen that the area of the tray at the forward end is provided with a cut out or recessed portion 31 which is effectively formed by the underside of the floor 12*b* of the tray and the downwardly projecting extensions 12*c* of the front side 12*a*. This cut out portion 31 allows the flames from the burner 15 to play directly on the underside of chute 23. In addition, however, chute 23 is so formed that a gap 32 exists between the front side 12*a* and the chute itself so that flames issuing through the cut out portion 31 can also play on the nozzle 14. This arrangement can be clearly seen in FIG. 2 where the interrelation of the recess 31, gap 32 and chute 23 can be readily ascertained.

The flame from the burner 15 thus heats the tray 12 and melts the lead charge but in view of the fact that the chute 23 and nozzle 14 are also heated the chute 23 and nozzle 14 are heated to a sufficiently high temperature by the time the lead in the tray 12 is turned sufficiently molten to issue through nozzle 14. When the level of molten lead is slightly above the nozzle inlet 14*a* the shot making operation commences.

The apparatus works best when the lead has an antimony content and while such lead has a very low melting point the nozzle 14 is heated, as aforementioned, to such a temperature that the molten lead can freely flow therethrough immediately the molten lead has reached its free flowing temperature.

The molten lead flows through the nozzle 14 to emerge in the form of droplets and these droplets fall onto the chute 23 which due to its downwardly inclined angle imparts a spin to the droplets. The droplets then run down the chute 23 and into the container 25 which as previously mentioned is filled with oil to cool and thus harden the droplets. Owing to the spin imparted to the droplets the cooled droplets have a substantially spherical form.

The oil displaced from the container 25 by the lead droplets flows into the overflow tray 29 and passes out of outlet 30 into the oil receiving container (not shown). The cooled oil in the container can subsequently be returned into the containers 25 as required. When the amount of droplets in the container has reached such a level that the temperature of the oil is too high the container is removed and replaced by the second container. The first container can then be emptied into the tray and the formed shot will remain in the container due to the mesh 28. This container can then be emptied of the formed shot and refilled with cool oil ready to replace the second container 25.

Referring to FIG. 2 of the drawings the nozzle 14 is shown in cross section. The nozzle has an internal passageway 33 which extends toward the outer end 34 thereof. Extending downwardly from internal passageway 33 to the undersurface 35 is the outlet jet 36 (which for clarity is shown slightly enlarged in FIG. 2). In use of the shot making apparatus jet 36 is vertically orientated so as to ensure that the issuing droplets fall vertically onto the inclined chute 23. In the preferred form of the invention the chute 23 is set at an angle of approximately 33.5° to the horizontal. It is also preferred that the undersurface 35 of nozzle 14 be substantially horizontally disposed and of a relatively smooth finish as to ensure that the droplets issuing from jet 36 break free from the undersurface 35. Once again it is preferred that this undersurface 35 be of curved transverse cross section so as to ensure the issuing droplets break free.

In the illustrated form of the invention it is necessary to ensure that the distance between the outlet end of outlet jet 36 and the surface of chute 23 is not too short as this will result in a continuous stream of molten lead issuing from the jet 36 whilst if the distance is too great the issuing droplets will tend to flaten on the chute 23 and a continuous flow of droplets from the end of chute 23 will not result. In the preferred form illustrated the distance from the end of outlet jet 36 to the chute surface is in the order of 8 mm. To ensure that the formed shot is of the required formation it is also preferable that the distance from the end of the chute 23 to the surface of the oil and container 25 be no greater than 25.4 mm.

During use the level of the molten lead within the tray 12 is maintained to a more or less uniform level by placing the unmelted lead on the rearward portion of floor surface 12*b* so that it progressively melts into the pool of molten lead. The level of lead is determined by the constitution of the lead and the size of the outlet jet 36 in nozzle 14. The head of lead is thus determined on a trial and error basis by increasing the head until the lead issuing from the jet 36 is a continuous stream whereupon the head is cut back until the continuous stream changes into a stream of individual droplets.

Figure 4:
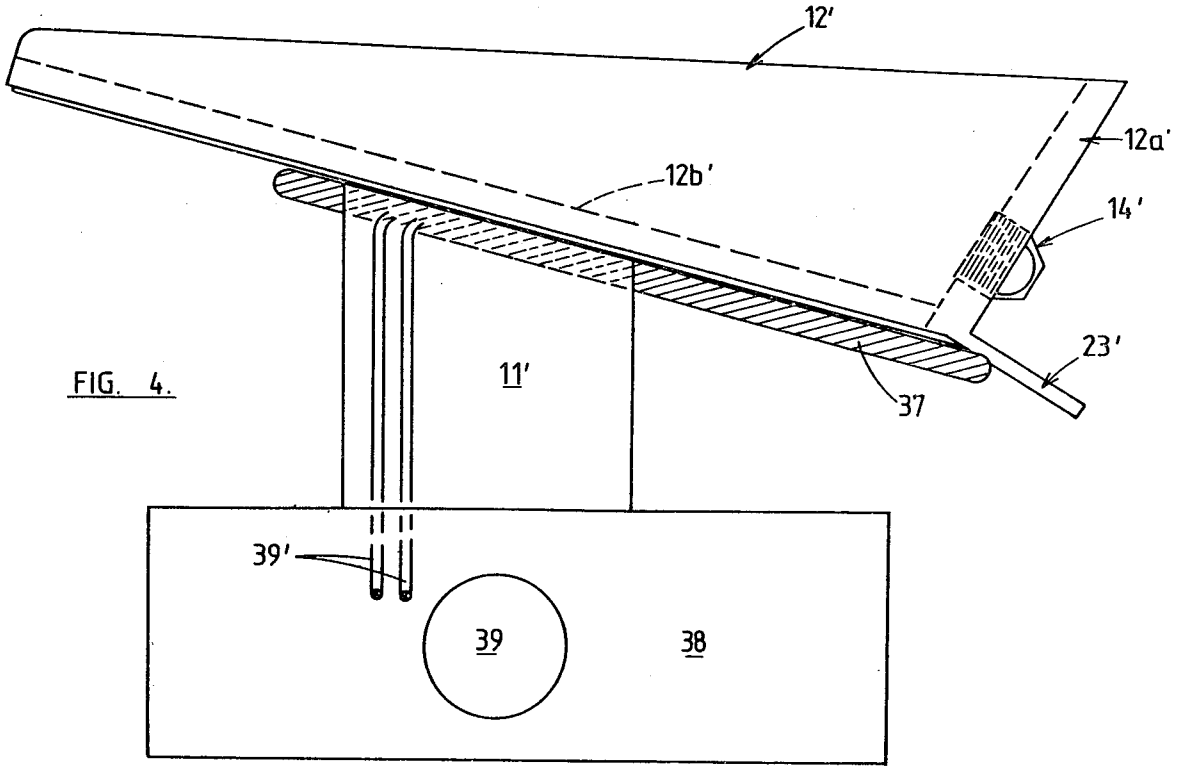
FIG. 4 is a side elevational view of a second form of the shot making apparatus according to the invention.

Referring now to FIG. 4 of the drawings a second form of the invention is illustrated and in this form the heating means is provided by an electric element 37 cast in or attached to the underside of the tray 12. In this form of the invention the tray is once more of a cast material but is preferably of an aluminium or aluminium alloy. In the illustrated form a pair of nozzles 14' are provided in the front side 12*a'* and chute 23' is formed by a flat projection extending from the lower end of front side 12*a'*. As can be seen by reference to FIG. 4 the element is cast in the base such that it extends underneath the chute 23'. In this way the element not only heats the floor 12*b'* of the tray 12' but also heats the chute 23'. Heat is also applied to the nozzles 14' by conduction through chute 23' and front side 12*a'* is that when the molten lead has reached the temperature at which it will flow freely through the nozzle 14' both the chute 23' and nozzle 14' have reached such a temperature that the apparatus operates correctly.

The tray 12' is supported on a support 11' which extends from a base 38. This base 38 contains a simmerstat which has a control knob 39 readily accessible to the user. A power flex (not shown) extends from base 38 and is coupled to the simmerstat which is in turn coupled by leads 39' to the electric element 37. In the preferred form of the invention as illustrated in FIG. 4 the element is of a 600 watt rating.

Figure 5:
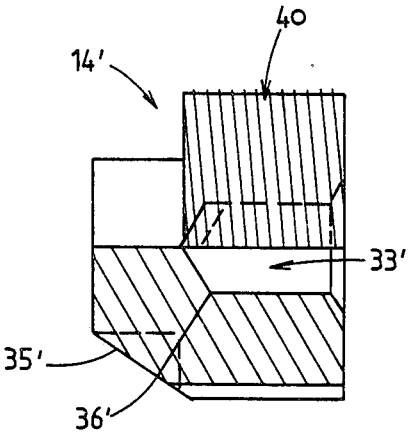
FIG. 5 is a cross-sectional view taken through the nozzle of the apparatus as depicted in FIG. 4.

In FIG. 5 the nozzle 14' of the form of the apparatus as illustrated in FIG. 4 is shown and as with the previously described embodiment is formed with an internal bore 33' having at its inner end thereof an outlet jet 36' which extends to the undersurface 35'. As with the previously described embodiment different size shot can be produced by selecting different size nozzles with the sizing of the nozzle being dictated by the diameter of the outlet jet 36'. The body of the nozzle 14' is provided with a screw threaded portion 40 thus allowing the nozzle to be readily inserted or removed from a threaded opening in the front side of the tray.

Figure 7:
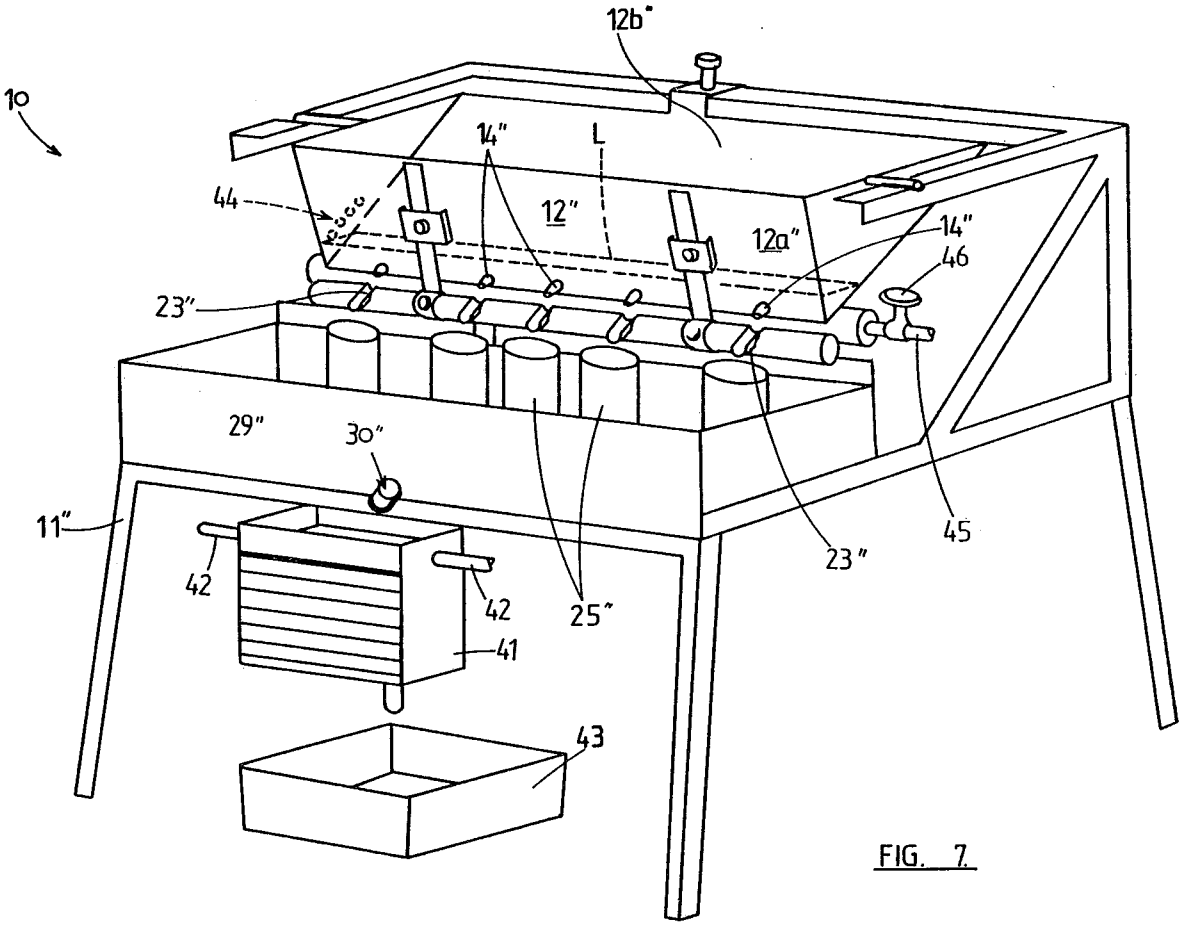
FIG. 7 is a perspective view of a third form of the shot making apparatus according to the invention.

Referring finally to FIG. 7 of the drawings there is illustrated an apparatus which can be used for quantity production of shot. This apparatus is on the same basic construction as the forms previously described in that it incorporates a tray 12″ which is supported by a support 11″. The front side 12*a*″ of tray 12″ has a plurality of nozzles 14″ which are positioned above chutes 23″. A container 25″ is located beneath each chute 23″ and these containers 25″ stand in an overflow tray 29″ which has a outlet 30″. Preferrably this outlet 30″ is positioned above an oil cooler 41. The oil cooler 41 in which oil is cooled by water circulating through the cooler by pipes 42 discharges the cool oil into the receptacle 43.

In this form the tray 12″ can be provided, in one of its sides, with a series of overflow openings 44 at respectively different heights above the base of the tray, each of the openings 44 being closed by a removable plug. Mounted beneath the tray 12″ is a heating unit consisting of a gas supply pipe 45 with burner outlets (not shown) arranged to direct gas flames against the base of the tray 12″, the nozzles 14″ and chutes 23″. The supply pipe 45 includes a gas stop valve 46.

The apparatus operates in the same manner as previously described however the head of molten lead L in the tray 12″ can be regulated by removal of the plug from a selected one of the overflow openings.

The chutes used in any of the preferred forms of the invention can be constructed from a suitable material but where the chute is constructed from steel or copper it is preferable to coat the chute surface with blackboard chalk to resist adherence of molten lead on the chute itself. Where the chute is, however, constructed from an aluminium or aluminium alloy material the chalking of the chute surface is not necessary.

The apparatus according to the invention in any of its preferred forms provides an effective and efficient means of producing shot. The shot thus produced is of uniform and good quality. By changing the size of the outlet opening in the or each nozzle the size of shot can be regulated.

What is claimed is:

1. Shot making apparatus comprising a receptacle for lead, heating means, at least one nozzle for discharging molten lead in droplet form from the receptacle, a chute associated with said at least one nozzle, the heating means being disposed such as to heat the chute, said at least one nozzle and the lead in the receptacle, the chute being disposed at a spacing from and at a downwardly inclined angle to said at least one nozzle, and a container or containers for liquid coolant and lead droplets discharged from said at least one nozzle.

2. Apparatus according to claim 1 wherein said at least one nozzle has an outlet jet through which said molten lead discharges, said jet being downwardly directed and located above the chute.

3. Apparatus according to claim 2 wherein the surface of said at least one nozzle in the immediate vicinity of the outlet end of said jet is curved.

4. Apparatus according to claim 1 or 2 wherein the receptacle is a tray having a downwardly inclined floor, said at least one nozzle being removeably located in the front side of said tray.

5. Apparatus according to claim 4 wherein the heating means is an electric element located at the underside of said tray with a part of said element located beneath said chute.

6. Apparatus according to claim 5 wherein a pair of nozzles are provided in the front side of said tray and a single chute in the form of a planar projection is located beneath said pair of nozzles.

7. Apparatus according to claim 6 wherein the tray and chute is cast as a single unit from aluminum alloy material.

8. Apparatus according to claim 4 wherein the heating means is a gas burner located beneath the underside of said tray and positioned such that in use flames therefrom play on the chute and said at least one nozzle.

9. Apparatus according to claim 8 wherein a gap is provided between said front side of said tray and the chute to permit said flames to play directly on said at least one nozzle.

10. Apparatus according to claim 1 or 2 wherein the surface of the chute located directly below said outlet jet is angled at approximately 33.5° to the horizontal.

11. Apparatus according to claim 10 wherein each container is filled completely with liquid coolant and the distance from the outlet end of said chute to the surface of the coolant is not greater than approximately 25.4 mm.

12. Apparatus according to claim 1 or 2 wherein the distance between the outlet end of said outlet jet and the surface of said chute is of the order of 8 mm.

13. Apparatus according to claim 2 wherein the each nozzle comprises a body with an internal passageway which, in use, is in communication with the lead in said receptacle, said outlet jet extending from the inner end of said passageway to the surface of said body such as to open from said body immediately above the chute.

14. Apparatus according to claim 1 wherein the containers are located in an overflow tray, said overflow tray having an outlet for coolant which overflows from said container and into said overflow tray.

15. Apparatus according to claim 14 wherein a heat exchanger is coupled to said outlet.

16. Apparatus according to claim 1 wherein a chute is located with each of said at least one nozzle.

17. Apparatus according to claim 16 wherein each chute is of substantially U shaped cross section.

18. Apparatus according to claim 1 wherein the coolant is oil.

19. Apparatus according to claim 2 or 13 wherein the undersurface of said at least one nozzle in which the outlet of the jet is located is normal to the longitudinal axis of the jet.

* * * * *